US006494643B1

(12) United States Patent
Thurner

(10) Patent No.: US 6,494,643 B1
(45) Date of Patent: Dec. 17, 2002

(54) SYSTEM AND METHOD FOR FASTENING AN OBJECT

(75) Inventor: Guenter Thurner, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 0 days.

(21) Appl. No.: 09/574,346

(22) Filed: May 19, 2000

(30) Foreign Application Priority Data

May 21, 1999 (DE) ..... 199 23 559
Dec. 16, 1999 (DE) ..... 199 60 854

(51) Int. Cl.[7] ..... A45F 3/44; E02D 5/80; E02D 27/42

(52) U.S. Cl. ..... 405/244; 405/232; 52/736.4; 52/165; 52/298; 256/1; 248/156; 248/530

(58) Field of Search ..... 405/230–232, 405/244; 52/736.1, 736.4, 103, 165, 298; 256/1; 248/156, 530

(56) References Cited

U.S. PATENT DOCUMENTS

| | | | | | |
|---|---|---|---|---|---|
| 1,523,977 | A | | 1/1925 | Pillar | 52/297 |
| 2,029,281 | A | | 1/1936 | McCann | 248/539 |
| 2,103,948 | A | | 12/1937 | Jones | 248/530 |
| 2,441,109 | A | | 5/1948 | Carlson | 248/530 |
| 4,290,712 | A | * | 9/1981 | Hayes | 256/1 X |
| 4,795,137 | A | * | 1/1989 | Witt | 256/1 |
| 4,832,304 | A | | 5/1989 | Morgulis | 248/530 |
| 4,884,363 | A | * | 12/1989 | Sofy | 248/527 X |
| 5,040,351 | A | * | 8/1991 | Cornwall | 52/736.4 X |
| 5,122,014 | A | | 6/1992 | Genfan | 405/244 |
| 5,358,209 | A | | 10/1994 | Ward | 248/545 |
| 5,457,918 | A | | 10/1995 | Plourde | 248/545 |
| 5,524,855 | A | | 6/1996 | Lesar | 248/530 |
| 5,571,229 | A | * | 11/1996 | Fitzsimmons et al. | 52/736.4 X |
| 6,032,880 | A | | 3/2000 | Verrills et al. | 248/545 |
| 6,234,444 | B1 | | 5/2001 | Haddad | 248/545 |

FOREIGN PATENT DOCUMENTS

| | | |
|---|---|---|
| DE | 2924432 | 4/1980 |
| DE | 9109701 | 10/1991 |
| DE | 4038962 | 6/1992 |
| DE | 4118695 | 12/1992 |
| DE | 9313258 | 3/1994 |
| DE | 9416433 | 2/1995 |
| DE | 29512237 | 11/1995 |
| DE | 29710432 | 9/1997 |
| DE | 29712900 | 11/1997 |
| DE | 19607972 | 1/1998 |
| DE | 19624738 | 1/1998 |
| DE | 19637985 | 3/1998 |
| EP | 590367 | 4/1994 |
| GB | 2068037 | 8/1981 |
| JP | 2-308078 | 12/1990 |
| JP | 8-240035 | 9/1996 |
| JP | 11-2049 | 1/1999 |
| JP | 11002049 | 1/1999 |

OTHER PUBLICATIONS

U.S. patent application Ser. No. 09/762,713, filed Mar. 8, 2001.

(E13) Catalogue "PASSAVANT Entwässerungstechnik K91" of the firm PASSAVANT, Mar. 1991 issue, pp. 162 and 164.

* cited by examiner

*Primary Examiner*—Thomas B. Will
*Assistant Examiner*—Tara L. Mayo
(74) *Attorney, Agent, or Firm*—Jordan and Hamburg LLP

(57) ABSTRACT

The invention relates to a fastening system with an anchoring device (1) and a method for fastening an object (2) in the form of a stake or post projecting up from the ground, with an anchoring portion (4) which can be introduced into the earth of the ground and can be removed again from it, or can be releasably fastened on the surface of the ground, and with a holding portion (5) for receiving the object, the holding portion having a cup-shaped or tubular filling portion (6), provided with a filling opening (12), for receiving a filler (7). The filler (7) comprises a coarse-grained, hard material in the form of sand, loose chippings or rock.

49 Claims, 14 Drawing Sheets

SYSTEM AND METHOD FOR FASTENING AN OBJECT

BACKGROUND OF THE INVENTION

The invention relates to a fastening system and a method for fastening an object in the form of a stake or post projecting from a surface, with an anchoring portion which can be introduced into an underlying structure bounded by the surface and can be removed again from it, or can be releasably fastened on the surface, and with a holding portion for receiving the object.

The erection of masts, posts, poles or stakes, for example for signs or fences, usually takes place directly by ramming them into the earth or by means of a foundation introduced into the earth for this purpose. With this procedure, the required vertical alignment entails considerable expenditure and requires the use of additional aids, which is laborious and, in particular, time-consuming. If it is concreted in, alignment of the object is no longer possible at all once the concrete has set.

In many cases, a mast or the like is not to be erected permanently but only for a time, for instance depending on the season, for example warning signs for hazards in winter or posts for setting up nets for ball games and the like. With the usual fastening methods mentioned above, a releasable connection is either not possible at all or requires additional measures.

In addition to ramming in, burying or concreting in an object, it is known to erect an object by means of a fastening system anchored in the earth. The anchoring device, which can receive the object to be erected at its upper, free end, includes at its lower end for example a screw or auger, which is screwed into the earth like a screw. The object to be erected is then inserted or screwed into the anchoring device or is screwed onto it. In the case of such arrangement as well, similar difficulties with regard to the use of additional aids exist regarding the alignment of the anchoring device in relation to the vertical and, in particular, when releasing the connection, and time-consuming additional measures are required.

SUMMARY OF THE INVENTION

The invention is based on the problem of providing a device and a method for fastening an object in the form of a stake or post projecting from a surface, in particular from the ground, with an anchoring portion which can be introduced into the underlying structure and can be removed again from it, or can be releasably fastened on the surface, and with a holding portion for receiving the object, with which device or method the object to be fastened can be aligned simply and in a short time and which permit sufficiently durable fixing of the object, even over prolonged periods, as well as comparatively quick and easily performed removal of the object.

The problem is solved according to the invention by a fastening system for an object in the form of a stake or post which includes a filler portion.

It is provided according to the invention that the holding portion has a cup-shaped or tubular filling portion, provided with a filling opening, for receiving a filler. The fastening system according to the invention therefore allows quick, easy-to-perform and exact alignment and positioning of the object in the form of a stake or post in relation to the holding portion, creating a durable fixing which needs no readjustment and can be easily released again. The components in the form of stakes or posts to be fastened may be variously designed, i.e. both cylindrical and conical components can be securely fixed, the conicity of the component also being formed in a frustoconical widening of the lower region of the component and/or in a conical tapering of the lower region of the component, thereby forming a relatively narrow annular gap. The system according to the invention and the method according to the invention can consequently be used for the secure fixing of a large number of components in the form of stakes or posts.

According to the invention, the filler is of such a nature that movement of the object in the holding portion is virtually ruled out. For this purpose, the filler expediently comprises a hard material in the form of sand, loose chippings or rock and/or a flexible plastic, such as granular material in particular. The invention is based on the surprising effect that filler which is, in itself, loose and to a certain extent "free-flowing" indeed permits a fastening of the object that is mechanically adequately stable, without the effect of the mechanical connection subsiding over time. In this case, on the one hand easy-to-perform corrections in the alignment of the object are possible, and on the other hand simple release of the connection is made possible by removing or taking out the filler. Tests with coarse-grained, hard loose chippings, as are used in road construction for example, have shown that secure fixing is possible just by the force of gravity of the filler introduced and the mechanical pressure of the filler acting on the object. After introducing the filler, the object is securely held, even under the effect of external vibrations, and does not exhibit any, or in any event any appreciable, positional changes. The coarse-grained material of the filler assumes a physically stable, essentially unchanging position after filling and securely holds the object. Not only coarse-grained rubble is possible for the material of the filler, although such a material appears to be particularly well suited (since canting of such a material achieves particularly great rigidity and positional stability of the filler, which is retained even under relatively great loading), but also rounded or even spherical rock material, such as pebble stones or the like, for instance.

A further aspect of the present invention is therefore that of providing filling material for the fastening of objects in the form of stakes or posts which has a rough, irregularly formed surface. With such irregular, but nevertheless approximately equal-sized filling-material elements, the advantageous effect of the device according to the invention is brought out particularly distinctly.

An additional aspect of the present invention is to fill the annular gap between the component in the form of a stake or post and the anchoring device only with individual particles or elements of the filling material in order to mount the component in the form of a stake or post in a secure and stable manner. This utilizes the effect that even just a few, but at least two, particles or elements of the filling material are sufficient in the relatively narrow annular gap between the component in the form of a stake or post and the anchoring device to bring about an adequate wedging effect to mount the component in the form of a stake or post securely and stably, in particular with respect to vertical forces. It must be ensured here that the annular gap is not greater than the diameter of the particles or elements of the filling material. It has therefore proven to be advantageous if the base region of the anchoring device has a cone in which the component in the form of a stake or post is centered and the annular gap enclosing the component in the form of a stake or post opens in the upward direction.

Also particularly suitable is a flexible plastics material, for instance a coarse- or fine-grained granular material, which can be produced in particular from recycled materials, for instance from scrap rubber (scrap tires) or other suitable reusable plastic waste products. One special advantage of using a flexible filling material exclusively or in addition to other material, apart from an improved fastening effect that is more stable on a long-term basis, is in particular the vibration-damping and stress-retaining properties of such flexible filling material.

The filler is preferably filled into the filling opening by means of a funnel-like filling tube that reaches at least partly around the circumference of the filling opening.

A major advantage of the invention is that there is simple and accurate positioning of the object to be fastened. Not only can the axial position of the object be easily set, but any desired position of the object within the holding portion can also be accomplished. In this way, it is readily possible with extremely simple handling still to accomplish a desired position or directional correction of the object to be fastened even when the holding portion is fitted at a slant or in a position deviating from the actual desired position.

It is favorable if the filling material is adequately coarse in comparison with the outer dimensions of the object, i.e. the outside diameter in the case of a cylindrical object, from approximately one to at least a few millimeters or even a few tens of millimeters. But even comparatively fine-grained sand with a grain size below one millimeter exhibits in principle the required mechanical strengths and is therefore similarly suitable for the purposes according to the invention; however, it is to be ensured by additional means that the filled small-grained sand material cannot escape. Expedient particularly for this eventuality is a closing material which completely closes the filling opening and with which a mechanical pressure is at the same time also exerted on the sand material for compacting it.

With adequately coarse-grained material, on the other hand, it is not necessarily required for the filling opening to be completely covered to achieve the connecting effect according to the invention, since such a filler normally achieves adequately high rigidity by itself and also remains positionally stable with respect to vibrations or weathering effects or other external loads. Nevertheless, a closing means that covers the filling opening of the filling portion at least in certain regions and is releasably fastened at the edge region of the filling portion may be expediently provided for increasing the strength of the connection.

According to a preferred development of the fastening system according to the invention, the cup-shaped or tubular filling portion for receiving the filler is formed by an insert which can be inserted into the holding portion of the anchoring device and removed again. Accordingly, the insert is preferably formed by a prefabricated part of plastic or sheet metal. The insert may additionally also be formed by a bag made of a film of flexible plastic or else made of woven material and expediently provided with a bottom reinforcement withstanding the weight of the object. Such an insert makes it possible in an extremely simple way for the filler to be taken out again from the filling portion after removal of the object. Dismantling of the fastening device, but also renewed fixing of an object in the form of a stake or post, is consequently easily and quickly possible.

The method according to the invention for fastening an object in the form of a stake or post projecting from a surface in the underlying structure or on the surface by means of a fastening system which has an anchoring portion which can be inserted into the underlying structure and removed again from it, or can be releasably fastened on the surface, and a holding portion for receiving the object, is distinguished by the following steps:

introducing the anchoring portion of the fastening system into the underlying structure or arranging the anchoring portion on the surface;

introducing, aligning and positioning the object in the holding portion of the anchoring device;

filling a filler into a filling portion, provided with a filling opening, of the cup-shaped or tubular holding portion, thereby securing the aligned position of the object; and, if appropriate durable fixing of the object by covering the filling opening by a closing means which covers the filling opening of the filling portion at least in certain regions and is releasably fastened at the edge region of the filling portion.

According to a preferred development of the method, it may be provided that the filler is permanently subjected to mechanical pressure or compressed by a clamping means. This method step is preferred in particular in the case of an angular filling material, and in turn in particular in the case of an angular hard material in the form of sand, loose chippings or rock, in order to counteract a reduction in the fastening effect caused over the course of time by vibrations or other mechanical effects of the object.

A further preferred method according to the invention consists in that coverage of the filling opening by closing means is not necessary for durable fixing of the object in the form of a stake or post, since the filler remains securely in the optionally usable insert or directly in the receiving region of the anchoring portion on account of its gravity, its blocking function and the static friction between the respective elements of the filler.

When a round or approximately round filling material is used, it is preferred in a development of the invention if the filling opening of the filling portion is covered by the closing means, in order that the filling material cannot escape from the filling portion, and at least a certain initial pressure is applied to the filler by the clamping means.

In a particularly preferred development of the invention, it is provided that the fastening system or its anchoring portion is screwed or knocked into the earth.

Furthermore, for use of the fastening system, objects in the form of stakes or posts which are designed essentially in a frustoconical form on their lower side may be used. Such a frustoconical surface at the lower end of the object in the form of a stake or post makes it possible for the objects in the form of posts to be fixed in a load-bearing and reliable way. This utilizes in particular the clamping mechanism of the filler, it not being important for an insert to be fitted in the actual receiving element of the anchoring portion. To achieve the necessary holding effect of the object in the form of a stake or post, it is sufficient for only an opening that is essentially triangular in section to be formed as an annular gap between the lower end of the object in the form of a stake or post and the holding portion. As soon as such a sectionally triangular annular gap has been formed and filler has been introduced into this intermediate space, the particularly advantageous wedging effect is brought about, permitting reliable and secure fixing of the object in the form of a stake or post according to the invention. A major advantage of the fastening system in connection with the component in the form of a stake or post to be fastened is that, with conically designed receiving elements of the anchoring portion, adaptation of the diameter of the object in the form of a stake or post, with for example a cylindrical inserting portion, is not required. The cone angle, i.e. the included angle of the triangular annular gap, has a magnitude of greater than 0° and less than 45°, preferably 3° to 15°.

A further aspect of the fastening system according to the invention is a dome-like compensating means which is arranged at the bottom of the insert in order to create a secure and stable supporting surface in the case of slanting components in the form of stakes or posts, which preferably include a tube. For this purpose, the dome-like compensating means is preferably a spherical cap which is either everted upward into the insert or formed downward as a depression. The dome-like compensating means is at the same time dimensioned in such a way that the annular supporting region of the component in the form of a stake or post rests with its entire circumference on it. The dome-like compensating means can be introduced as a removable component according to requirements into the bottom region of the insert, if the component in the form of a stake or post cannot be aligned coaxially with the anchoring device. In this case, the dome-like compensating means forms the supporting surface for the hollow component in the form of a stake or post, in order that filler does not get under the supporting edge of the component and in order that the latter does not consequently slip away on the planar base of the insert on account of being supported by its edge on one side.

An additional aspect of the present fastening system is that of providing centering means which center the components in the form of stakes or posts in their position in relation to the vertical. The centering means may in this case comprise the conical inner region of the anchoring device or attachable centering means, for example in the form of disks, which can preferably be arranged on the upper side of the insert radially with respect to the component in the form of a stake or post. It is optionally also possible for both centering means to be used, i.e. centering in the conical bottom region and centering by means of disks.

The fastening system according to the invention can consequently be constructed in a modular manner according to requirements from a plurality of component parts. The individual component parts of these fastening systems comprise:

an anchoring device, for example a bottom plug, knocking-in sleeve or mounting stand;

an insert for inserting into the anchoring device, optionally cylindrical or conical, optionally with a centering function in the lower or upper region of the insert;

individual filler particles for fixing the components;

a multiplicity of filler particles for filling up the insert or the anchoring device;

centering means for centering the components in the form of stakes or posts at the upper region of the anchoring device;

centering means for centering the components in the form of stakes or posts at the lower region of the anchoring device;

closing means without a centering function, with which the filler is subjected to mechanical stress;

a dome-like compensating means for slanting anchoring devices or components to be erected at a slant.

On the basis of these modular components, different exemplary embodiments of the fastening system according to the invention can be formed, the following list giving some but not all exemplary embodiments of the possible combinations of the modular fastening system.

Example 1: fastening system comprising an anchoring device with a conical inside wall, into which the component in the form of a stake or post is inserted and with which the space between the component in the form of a stake or post and the anchoring device is filled by means of a multiplicity of filler particles.

Example 2: fastening system comprising an anchoring device into which there is fitted an insert with a conical inside wall, into which the component in the form of a stake or post is inserted, and the space between the component in the form of a stake or post and the insert is filled by means of a multiplicity of filler particles.

Example 3: fastening system comprising an anchoring device into which there is fitted an insert with a cylindrical inside wall, into which the component in the form of a stake or post is inserted, and the space between the component in the form of a stake or post and the anchoring device is filled by means of a multiplicity of filler particles.

Example 4: fastening system comprising an anchoring device with a cylindrical inside wall, into which there is fitted an insert with a conical inside wall, into which the component in the form of a stake or post is inserted, and the space between the component in the form of a stake or post and the anchoring device is filled by means of a multiplicity of filler particles.

Example 5: fastening system comprising an anchoring device with a conical inside wall, into which the component in the form of a stake or post is inserted and centered by centering means at the end of the component, and the space between the component in the form of a stake or post and the anchoring device is filled by means of individual filler particles in such a way that these filler particles exert a clamping effect, in particular in response to vertical forces.

Example 6: fastening system comprising anchoring device with a conical inside wall, into which the component in the form of a stake or post is inserted and centered by centering means at the upper region of the anchoring device.

Example 7: fastening system comprising an anchoring device with a conical inside wall, into which the component in the form of a stake or post is inserted and centered by centering means at the upper region of the anchoring device, and with which the space between the component in the form of a stake or post and the anchoring device is filled by means of individual filler particles in such a way that these filler particles exert a clamping effect, in particular in response to vertical forces.

Example 8: fastening system comprising an anchoring device with a conical inside wall, into which the component in the form of a stake or post is inserted and centered by centering means at the upper region of the anchoring device and at the end of the component, and in which the space between the component in the form of a stake or post and the anchoring device is filled by means of individual filler particles in such a way that these filler particles exert a clamping effect, in particular in response to vertical forces.

Example 9: fastening system comprising an anchoring device and an insert, into which the component in the form of a stake or post is inserted and centered by centering means at the bottom of the insert and the space between the component in the form of a stake or post and the insert is filled by means of individual filler particles in such a way that these filler particles exert a clamping effect in response to vertical forces.

Example 10: fastening system comprising an anchoring device and an insert, into which the component in the form of a stake or post is inserted and centered by centering means at the bottom and at the upper region of the insert.

BRIEF DESCRIPTION OF THE DRAWINGS

Preferred exemplary embodiments of the invention are explained below with reference to the drawing, in which.

DETAILED DESCRIPTION OF THE INVENTION

Figure 1:
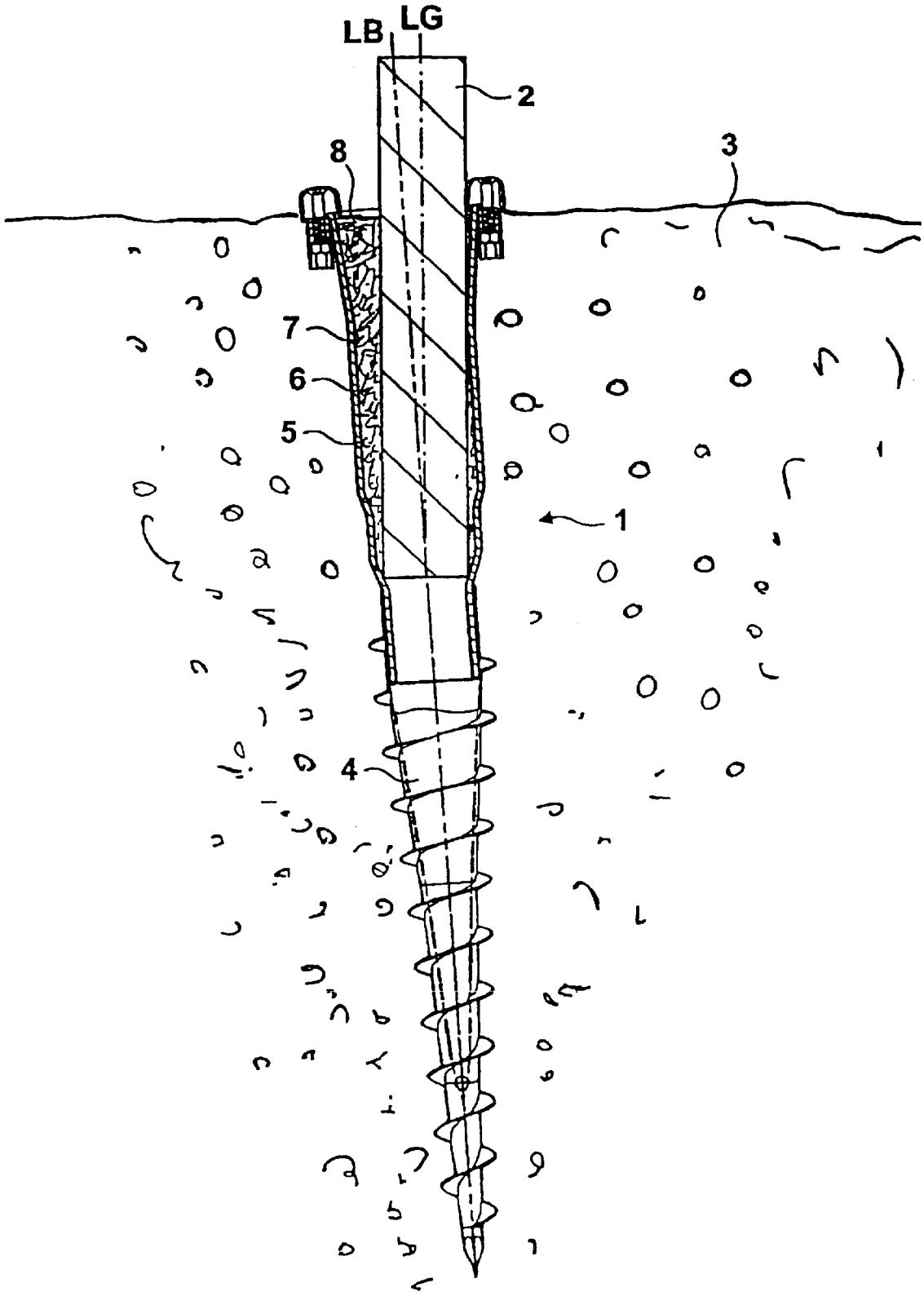
FIG. 1 shows a schematic sectional representation of an overall view of a first exemplary embodiment of the fastening system according to the invention.

The exemplary embodiments of a fastening system according to the invention are represented in the figures. A fastening device 1 for an object 2 in the form of a stake or post in the earth 3, includes an anchoring portion 4 which can be introduced into the earth 3 and removed again from it and has a thread, and comprise a holding portion 5, which adjoins the anchoring portion 4 and is intended for receiving the object 2. The holding portion 5 has a cup-shaped or tubular filling portion 6, which is provided with a filling opening 8 and is intended for receiving a filler 7. The filler 7 comprises a coarse- or fine-grained, hard material in the form of sand, loose chippings or rock.

Figure 3:
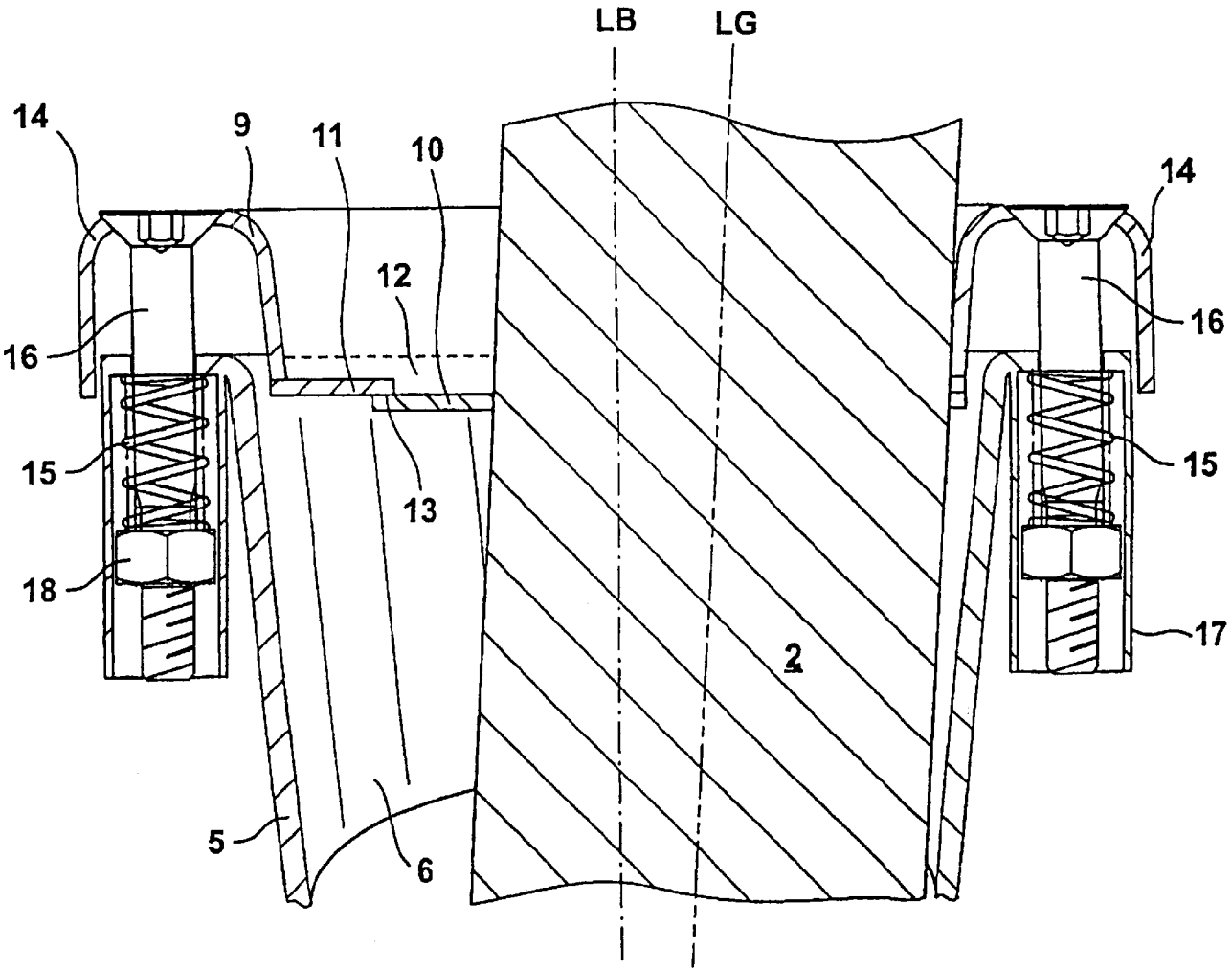
FIG. 3 shows a schematic sectional representation in an enlarged view of the upper portion of the fastening system according to the first exemplary embodiment.

For closing the filling portion 6, which is formed in such a way that it is open at one end in the upward direction and is otherwise closed, a closing means 9 that covers the filling opening 8 at least in certain regions and is releasably fastened at the edge region of the filling portion 6 is provided, further details of which can best be seen from the representation according to FIG. 3. The closing means 9, made of metal or plastic, comprises an annular portion 11, the outer dimensions of which are somewhat smaller than the inner dimensions of the upper region of the holding portion 5, and which is provided with a bore 12, through which the object 2 is passed. The bore 12 may have a diameter which corresponds to the outside diameter of the object 2, or, as in the exemplary embodiment represented in FIG. 3, may have a much greater diameter than that of the object 2. Also provided is an independently produced plate or disk 10 of metal or plastic, which is provided with a bore that allows the passage of the object 2 and the diameter of which corresponds to the outside diameter of the object 2. The arrangement comprising the plate 10 and annular portion 11 lying above it permits an adequately sealed closure of the filling opening 12, the dimensions of the plate 10 and the bore 12 of the annular portion 11 having been chosen such that, with the object 2 aligned in any way desired, there is an overlapping region 13 of the annular portion 11 and the plate 10.

In particular with relatively small outside diameters of the object 2, of typically a few centimeters or less, a plurality of plates of different dimensions and bores, lying one above the other, may be used instead of the one plate 10, in order to achieve a sealed closure of the filling opening 8—depending on the grain size of the filling material used. It is sufficient for the closure to be sealed adequately enough that any remaining gaps are smaller than the grain size of the filling material used, in such a way that any escape of filling material from the holding portion is avoided.

A special advantage of using such plates or disks 10 of different dimensioning is that posts of different outer dimensions and shapes can be fastened, without differently shaped plates 10 being required. In this way, not only round posts 2 but also posts of any other desired cross-sectional forms, for instance square or polygonal posts, can be fastened.

The closing means 9 has, furthermore, a flange portion 14 that is collar-shaped or U-shaped in profile, by which the closing means 9 can be fixed on the edge region of the holding portion 5. This takes place in the way represented by means of a plurality of screw bolts 16 that are distributed on the circumference of the flange portion 14 and are releasably fastened by means of compression springs 15 or other flexible elements, which are mounted in sleeves 17 integrally formed on the edge region of the holding portion 5, and screw nuts 18.

The mode of operation is as follows.

Figure 2:
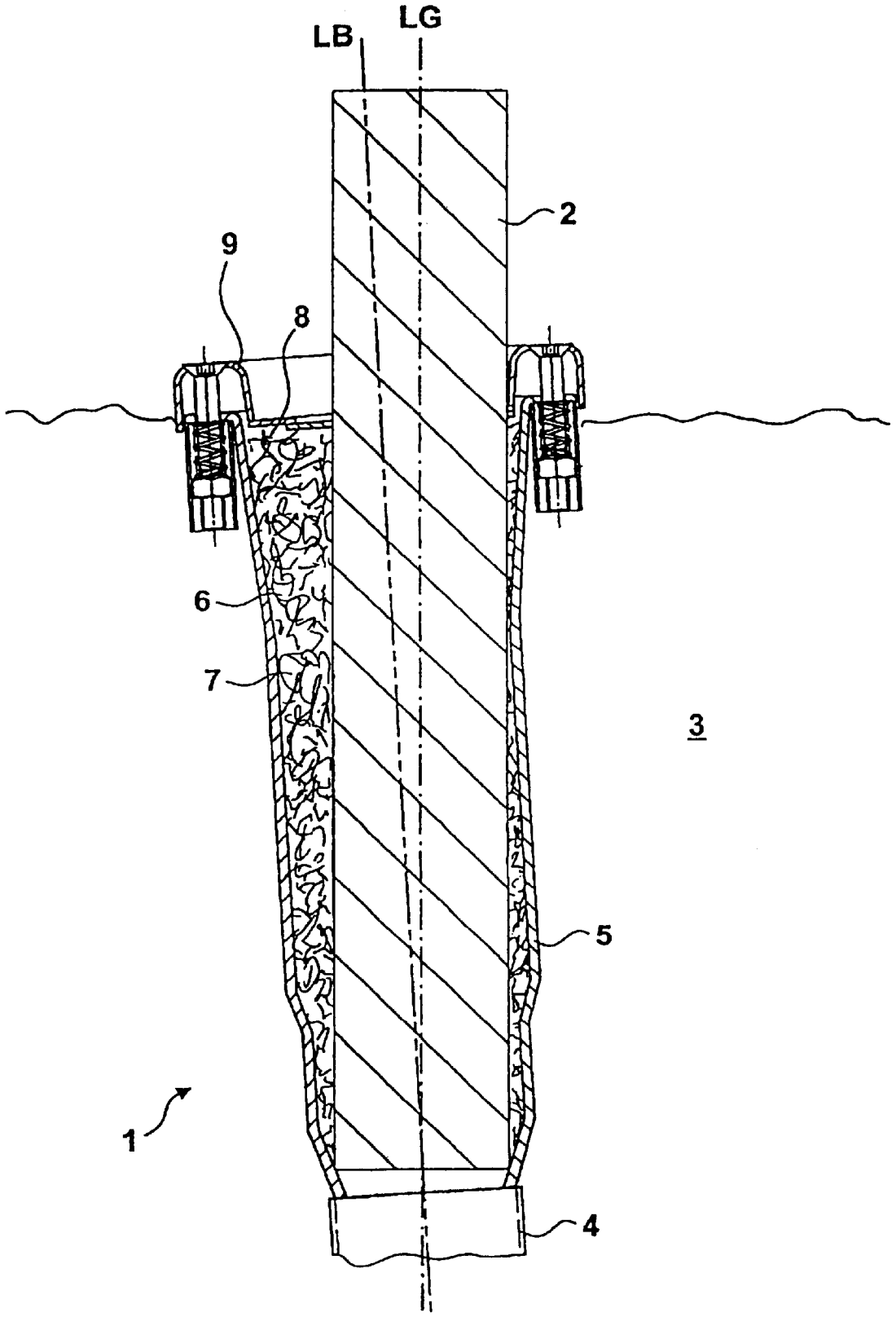
FIG. 2 shows a schematic sectional representation of the holding portion of the fastening system according to the first exemplary embodiment.

For introducing it into the earth 3, the anchoring device 1 is turned by a tool placed on the holding portion 5 and is screwed into the earth 3 by means of the threaded portion 4. A slanting position of the longitudinal center axis LB of the holding portion in relation to the vertical is not problematical here in the way it is with conventional concreted-in posts, since it can be compensated. After screwing the anchoring device 1 into the earth 3, the object 2 in the form of a stake or post is introduced into the holding portion 5 adjoining the threaded portion 4 (see FIG. 2). The object 2, initially introduced loosely into the holding portion 5, is aligned with respect to the vertical, it not being necessary for the longitudinal center axis LG of the object 2 and the longitudinal center axis LB of the holding portion to lie on top of one another. The remaining filling space 6, not filled by the object 2 in the holding portion 5, is then filled with a coarseor else fine-grained hard filler 7, such as loose chippings, up to the upper edge of the filling portion. The object 2 is then in itself positionally secured in an essentially stable and durable manner, and after that can be shifted in a direction transverse to the vertical by using relatively great expenditures of force. For covering over the filling opening, the plate 10 is placed on top. For final positional securement, the closing means 9 is tightened by means of the screw bolts 16, exerting a mechanical prestress on the plate 10, and consequently on the filler 7. The closing means 9 consequently brings about complete closure of the filling opening 8 and—by means of the plate 10—at the same time applies a mechanical stress to the filler introduced into the filling portion 6 of the tubular holding portion 5.

Figure 4A:
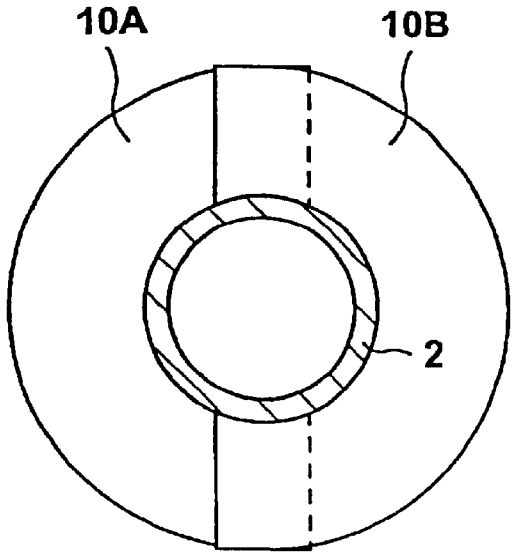
FIGS. 4A, 4B, 4C show schematic representations in plan view of different plates of the closing means according to preferred exemplary embodiments of the fastening system according to the invention.
Figure 4B:
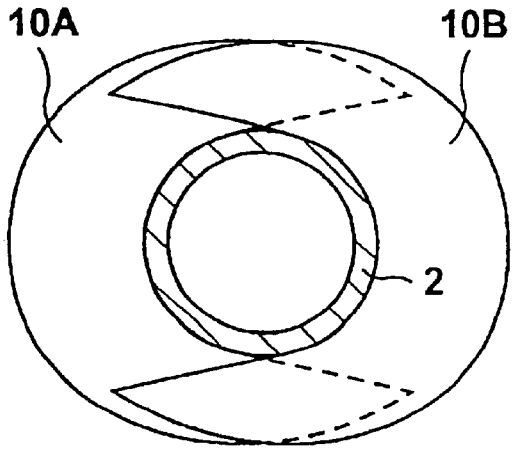
Figure 4C:
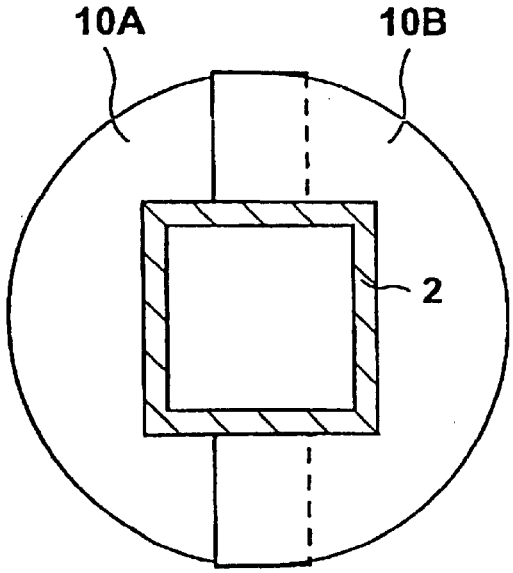

FIGS. 4A to 4C show further details of variants of a covering enclosing the object and closing the filling opening 8. The covering is formed here in each case by two independent, prefabricated plates 10A and 10B of plastic or sheet metal, which are provided with clearances adapted to the cross-sectional form of the object 2 to be inserted, and, lying one on top of the other, cover the filler 7 by overlapping. In the case of the embodiment according to FIG. 4A, the plates 10A and 10B are formed by half-ring-shaped sheet-metal parts, the free ends of which are shaped in an overlapping manner. In the case of the embodiment according to FIG. 4B, the two plates 10A and 10B have a sickle-shaped form, with an inner arc of the sickle adapted to the cross-sectional form of the object 2 to be inserted and an outer arc of the sickle adapted to the radius of curvature of the filling opening 12, the free ends of the sickles in turn being shaped in an overlapping manner. FIG. 4C finally shows an embodiment in which the plates 10A and 10B are shaped such that they are adapted to a square cross section of the object.

Figure 5A:
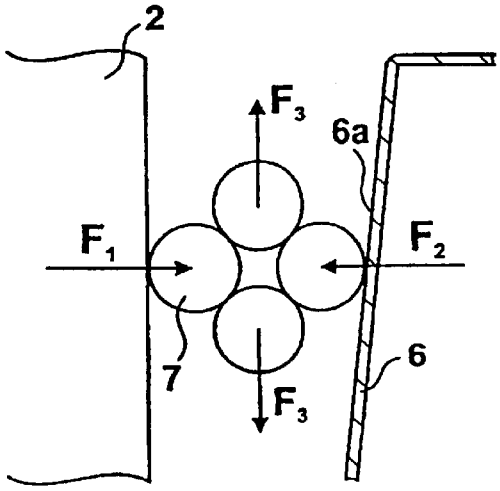
FIGS. 5A, 5B, 6A, 6B show schematic partial sectional views to explain the relative forces produced with different filling materials.
Figure 5B:
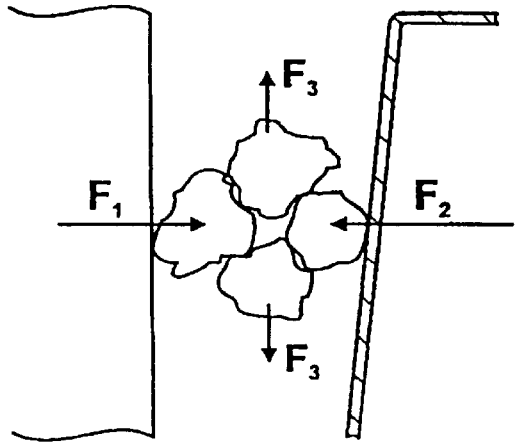
Figure 6A:
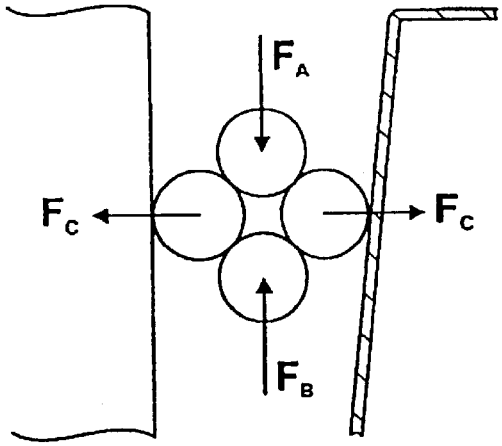
Figure 6B:
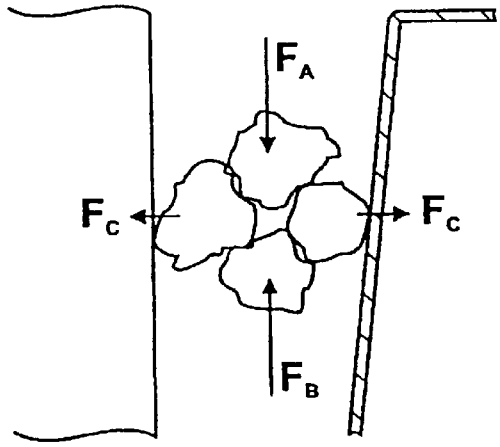

According to the exemplary embodiments of the invention, the filler used may have different outer shapes; both angular and rounded or even spherical material, in particular rock material, is suitable. In the schematic representations according to FIGS. 5A, 5B, 6A, 6B, the relative forces in the two limiting cases of a spherical rock material (FIGS. 5A, 6A) on the one hand and an extremely angular rock material (FIG. 5B and FIG. 6B) on the other hand are explained. FIGS. 5A and 5B reproduce here the conditions in the load case without any additional external compressive or stressing effect on the filler, i.e. the relative forces of the filler on the fastened object, whereas FIGS. 6A and 6B show the relative forces in the filling material when there is additional stressing of the filling material by the clamping device. The force $F_1$ is the force exerted by the held object 2 on the filler 7, $F_2$ is the corresponding counterforce with respect to $F_1$ from the wall 6*a* of the filling portion 6, $F_3$ are the upwardly and downwardly directed deflected forces of the "loose" filling material (FIGS. 5A, 5B), the force $F_A$ is the force exerted on the filling material by the clamping device, $F_B$ is the corresponding counterforce with respect to $F_A$ and $F_C$ is the clamping force acting on the object 2 or the wall 6*a* of the filling portion 6 (FIGS. 6A, 6B). The arrows respectively assigned to the forces indicate the direction and the magnitude of the forces acting.

Tests with different filling materials have provided the following findings, which are to be explained with reference to FIGS. 5A, 5B, 6A, 6B. Round filling material adopts a stable, sealed position from the outset and fills the volume better, without being further compacted or allowing itself to be compacted. The conversion of the clamping forces is already at an optimum. Therefore, in the case of round filler, the use of a covering is sufficient for the purpose according to the invention of adequately fastening the object, in order that the round filling material which has been filled cannot escape in the upward direction, it being intended for the covering to be under a certain prestress with respect to the filling material in order to secure the position of the filling material. Since the risk of the fastening effect being reduced over the course of time is far less in the case of round filling material than in the case of angular material, additional, subsequent stressing by means of flexible elements is not absolutely necessary in the case of round filling material. It can be seen from FIGS. 5A and 6A that the clamping forces acting on the object are sufficiently great without the use of a force-exerting pressure plate, as long as the filling opening is firmly closed in a covered manner to the extent that the upwardly directed forces $F_3$ are supported.

The relative forces are different in the case of angular filler (FIGS. 5B, 6B). On account of the irregularity of the outer shaping, and resultant unstable positioning of the filled material, an angular filling material cannot adopt a position in which it completely fills the volume and, after exertion of a mechanical pressure, allows itself to be further compacted or disintegrates. To achieve adequate fastening, it therefore appears to be necessary when using angular filling material to use a clamping device, by means of which the angular filling material is compressed, at least in cases where the fastening effect has to meet relatively high requirements, for example flag poles and similar relatively large objects. On the other hand, when angular filling material is used it is not necessarily required for the filling opening to be completely covered, since escape of the material in the upward direction occurs far less, on account of the better transfer of the forces of the angular filling materials among one another.

Figure 7:
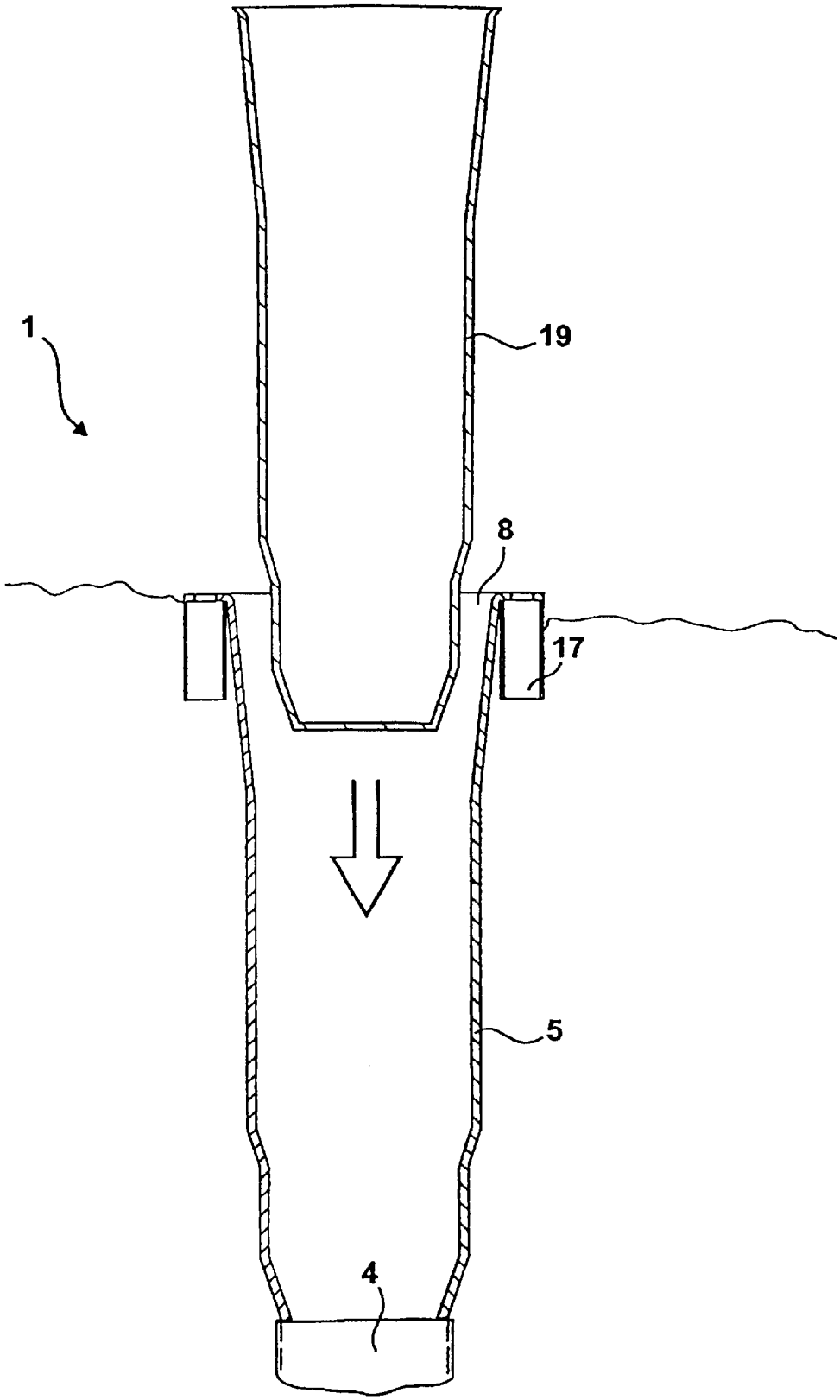
FIG. 7 shows a schematic sectional representation of an insert of the fastening system according to a further exemplary embodiment of the invention.

FIG. 7 shows a further preferred exemplary embodiment of the invention, according to which the fitting, but also renewed erection or alignment of objects 2 in the anchoring device 1 is further simplified. An insert 19 shaped such that it is adapted in a way corresponding to the inner dimensions is provided, which insert may be produced from sheet metal or plastic and is introduced before the object 2 and the filler 7 into the holding portion 5 through the filling opening 12 into the anchoring device 1. After removing an object 2 from the anchoring device 1, the filler 7 then does not have to be removed, but instead the insert 19, with the filler 7 in it, is taken out in a simple manner and, after emptying, can be re-used. This makes it possible for an object 2 in the form of a stake or post to be erected and dismantled in a durable, in particular quick and uncomplicated way.

Figure 8:
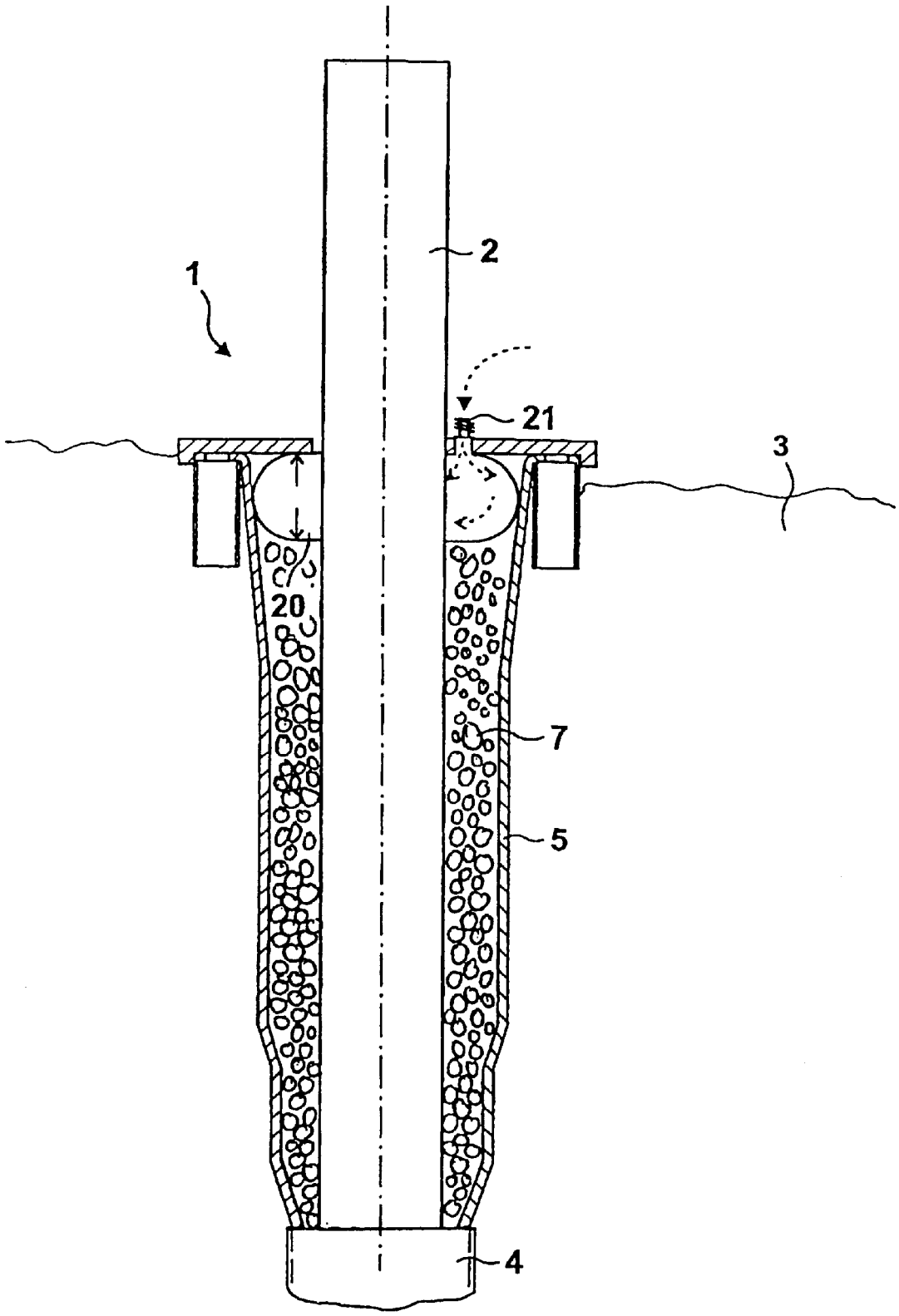
FIG. 8 shows a schematic sectional representation of a fastening system according to a further exemplary embodiment of the invention with a closing means in the form of an inflatable air tube.
Figure 9:
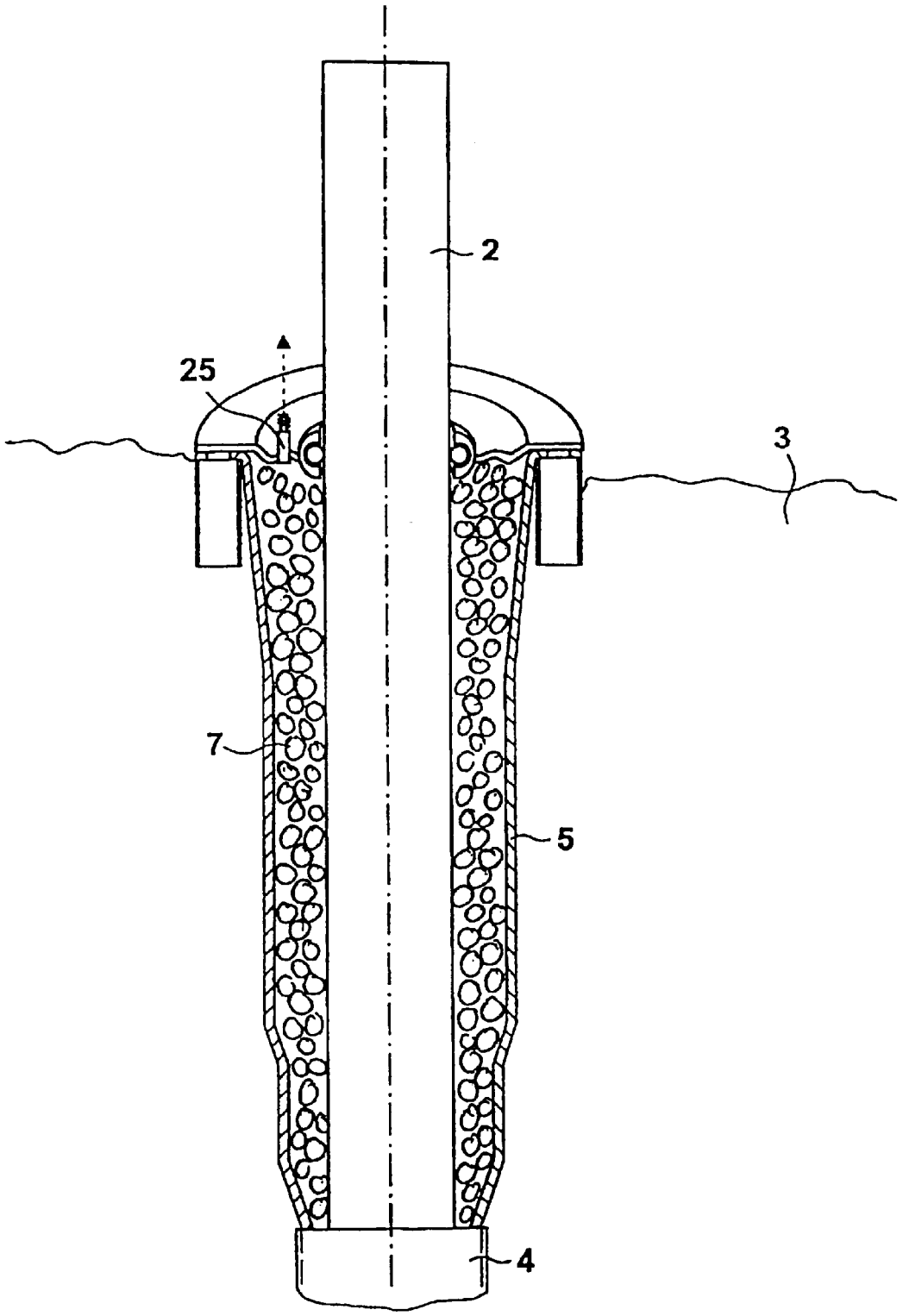
FIG. 9 shows a schematic sectional representation of a fastening system according to a further exemplary embodiment of the invention with a closing means in the form of a vacuum device.

FIGS. 8 and 9 show embodiments of the invention in which the closing means is formed by a device which is subjected to pressure or generates pressure in relation to ambient atmospheric pressure.

According to FIG. 8, the anchoring device has a closing means in the form of an inflatable air tube 20, which can be connected to an air pump via an air valve 21. Once the object 2 has been introduced into the holding portion 5 and aligned and the filling portion has been filled with the filler 7, the air tube 20, which may be a commercially available bicycle tube for example, is placed onto the filler and, after fastening the closing means, is pumped up.

In the case of the embodiment according to FIG. 9, the anchoring device 1 has a closing means in the form of a vacuum device with a sealing collar integrally formed on the upper region of the holding portion, and an O-ring 22, which ensure an airtight closure of the holding portion with respect to the object 2. A subatmospheric pressure can be generated in the filling space by means of a vacuum valve 25 which can be connected to a pump, as a result of which the filler is subjected to mechanical stress by the surrounding atmospheric pressure, and this stress is retained even when opposed by a compaction of the filling material that may occur over the course of time under certain circumstances, and resultant reduction in the fastening effect.

In the case of both embodiments according to FIGS. 8 and 9, a special advantage lies in the compressibility of air and, associated with this, good maintenance of the compressive stress acting on the filling material, even over a prolonged period of time.

Figure 10:
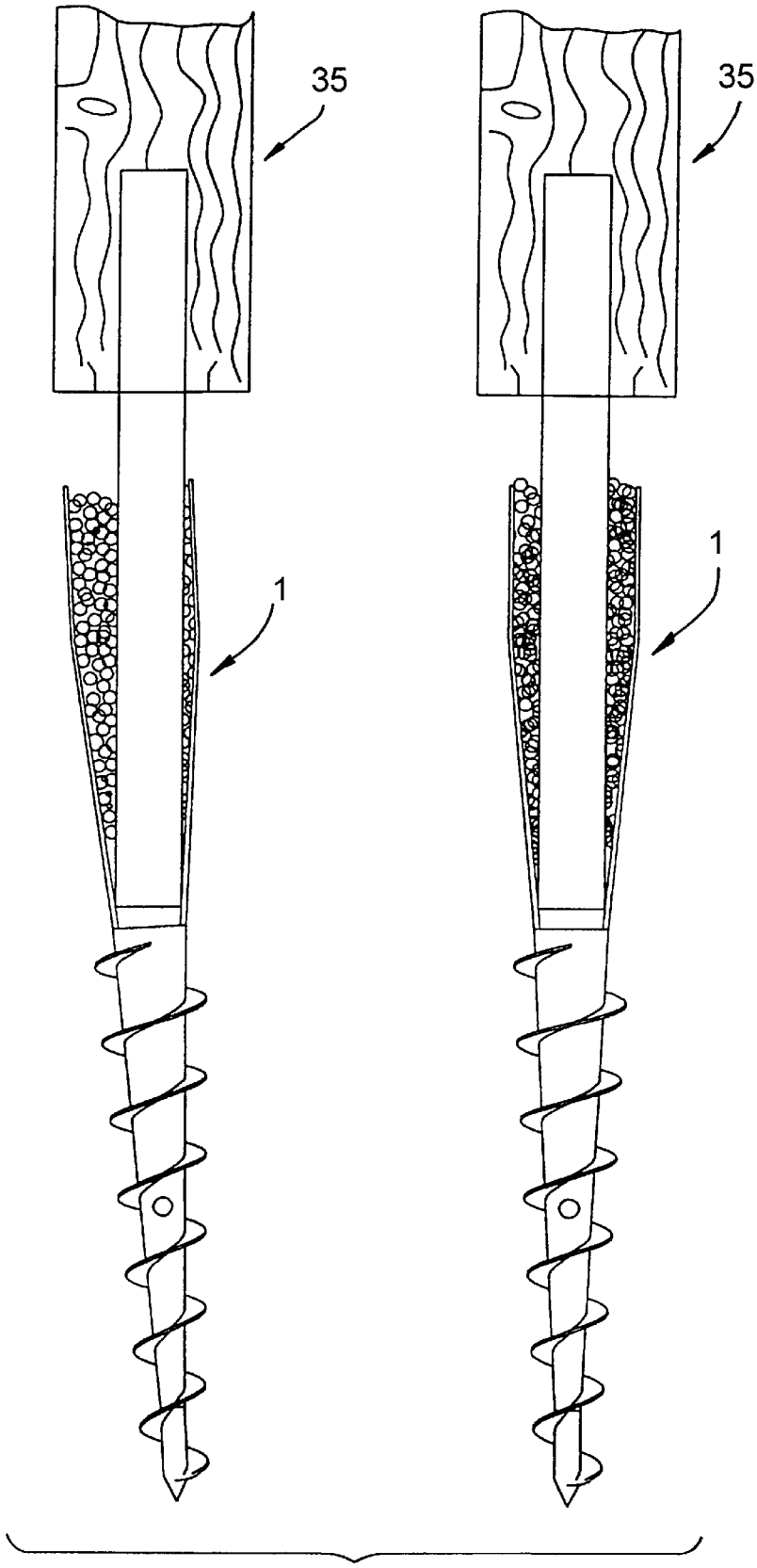
FIG. 10 shows a schematic representation of two fastening systems which respectively bear a possibly connected wooden structure.

FIG. 10 shows two fastening systems, the left-hand fastening system not being aligned axially parallel, in contrast to the right-hand fastening system. Nevertheless, in both fastening systems possibly interconnected wooden structures 35 that are aligned essentially axially parallel are anchored. Such an arrangement, which is not restricted to just two fastening system, can be used for example for the foundation structure of a wooden hut or the like, and by virtue of the axial compensating capability of the fastening systems according to the invention, can also be used on uneven terrain.

Figure 11:
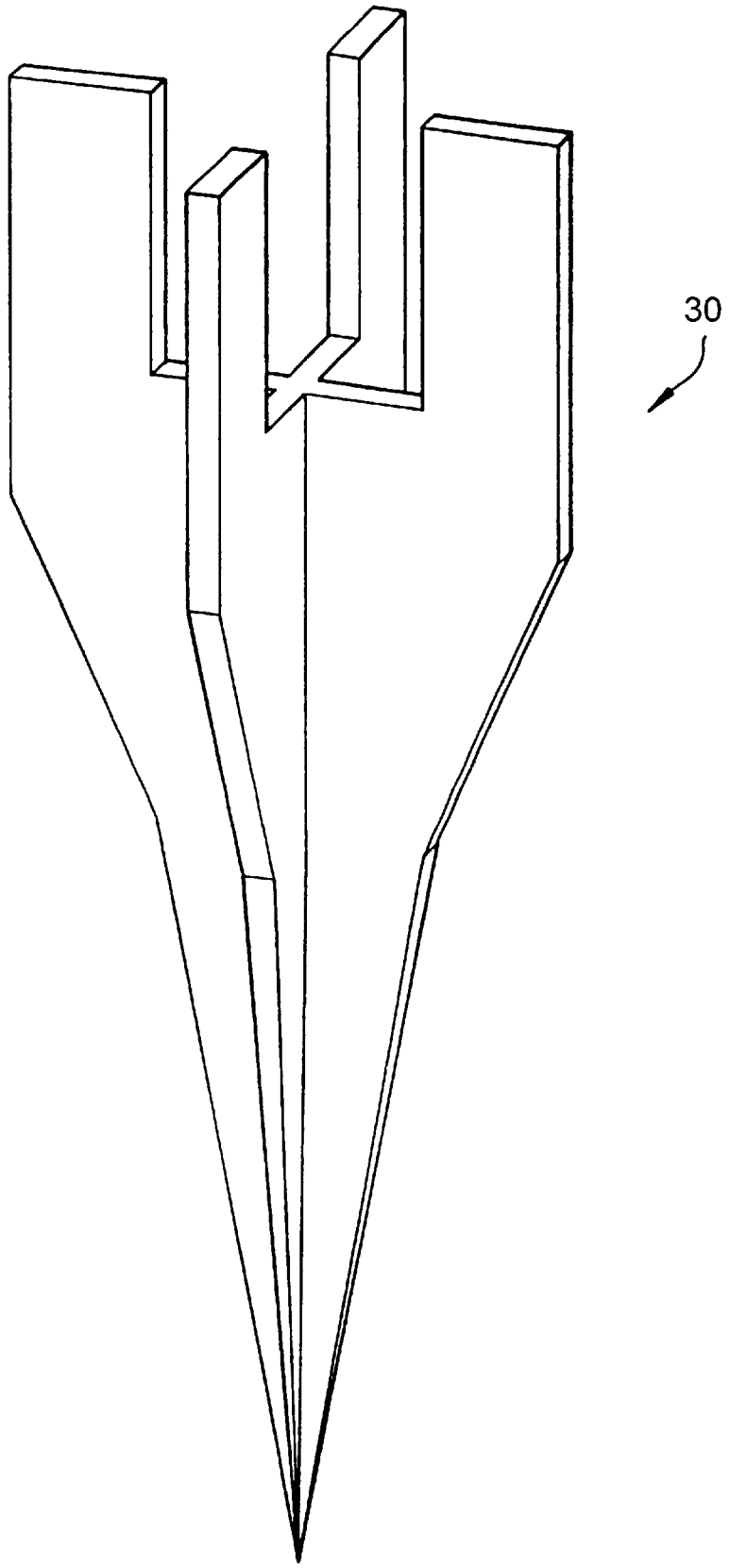
FIG. 11 shows a perspective representation of a so-called knocking-in sleeve.
Figure 12:
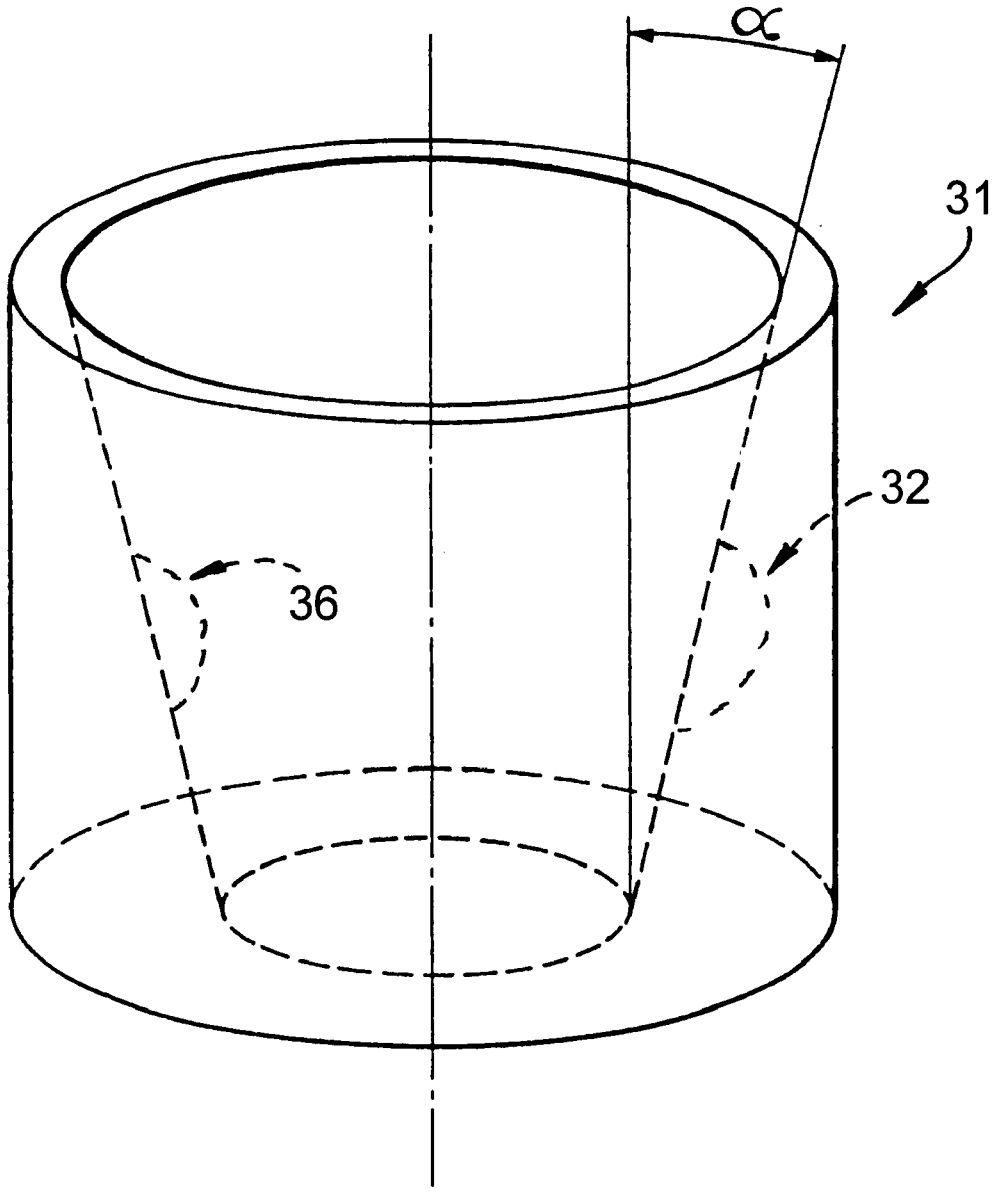
FIG. 12 shows a perspective representation of an insert for a knocking-in sleeve.

So-called knocking-in sleeves 30 according to FIG. 11 can also be used as the fastening system for receiving the objects in the form of stakes or posts, which sleeves have in cross section at least two crossing plate-like parts, of a conical/pointed design, gave segments that are arranged radially around the circumference and leave a cut-out region on the inside, in which there can be fastened, for example, an insert 31, as a pot, for example, with dome-shaped eversion 36 and/or dome-shaped depression 37, according to the invention as shown in FIG. 12 for receiving the objects in the form of stakes or posts. The insert preferably has an inner cone, in which a stake, in particular a cylindrical stake, can be fixed with filler. The insert may also have a cylindrical inner form, the stake then being of a conical design. Similarly, the receiving region of the knocking-in sleeve may be designed such that it tapers in the downward direction and the insert according to the invention may have a conical outer contour.

Figure 13:
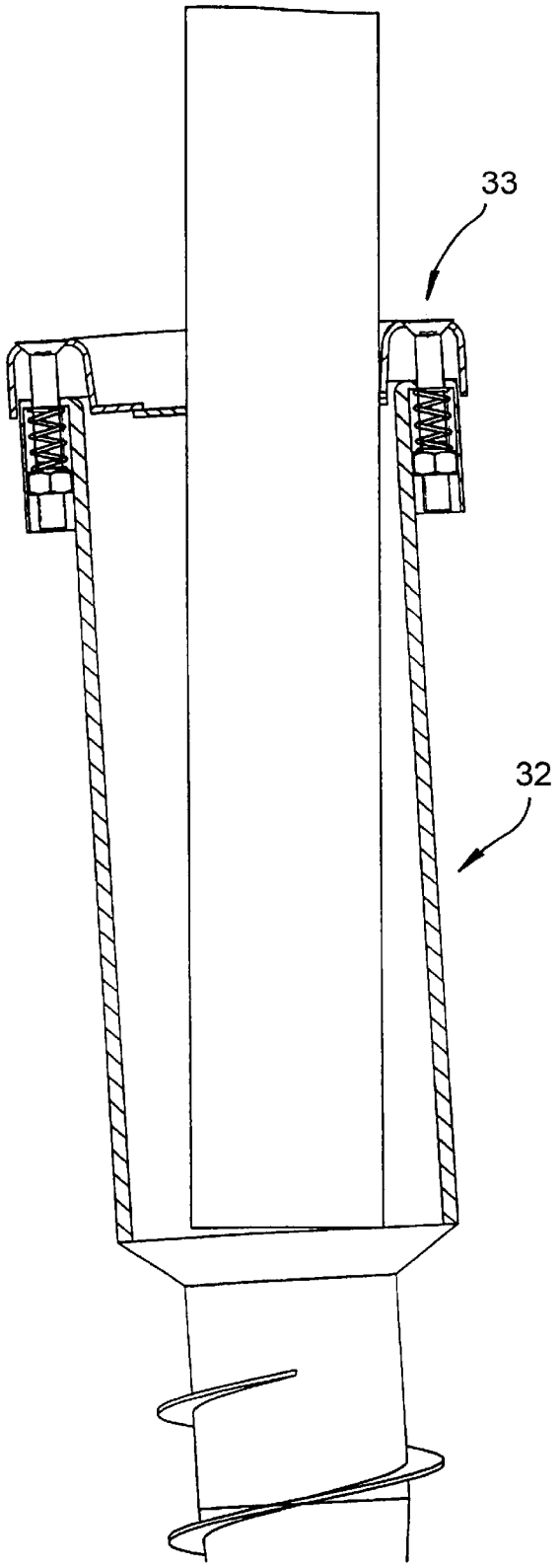
FIG. 13 shows a schematic sectional representation of a fastening system according to a further exemplary embodiment of the invention with sickle-shaped closing means which act as centering means.

FIG. 13 shows a fastening system according to the invention, with a cylindrical holding portion 32 and a sickle-shaped closing means 33, which centers the component in the form of a stake or post in the upper region of the holding portion.

Figure 14:
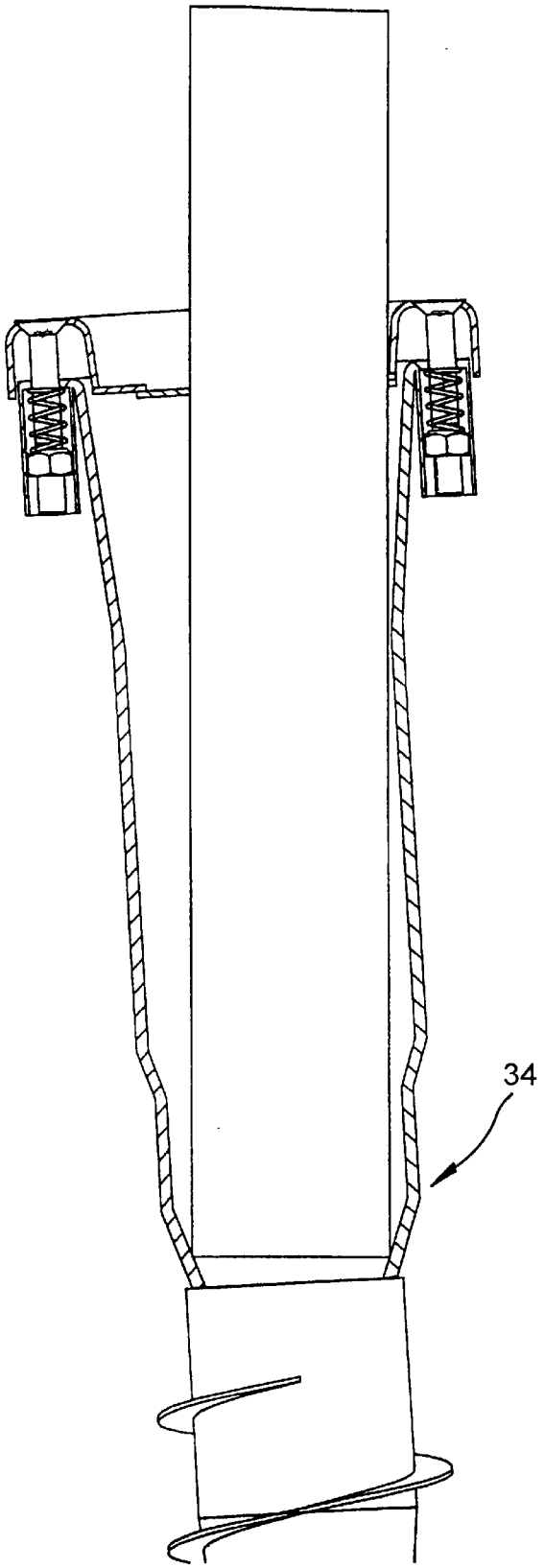
FIG. 14 shows a schematic sectional representation of a fastening system according to a further exemplary embodiment of the invention with sickle-shaped covering means, which act as centering means, and a conical centering means in the holding portion of the anchoring device.

FIG. 14 shows a fastening system according to the invention, with a cylindrical holding portion and a sickle-shaped closing means, which centers the component in the form of a stake or post in the upper region of the holding portion and has a centering means 34 in the lower region of the holding portion. This centering takes place by a tapering of the holding portion cross section, so that the usually annular lower end of the component rests against the inside wall of the holding portion on the entire circumference. For increasing the holding force, it is particularly advantageous to place a few particles of the filler into the annular gap between the component in the form of a stake or post and the inside wall of the holding portion, in order in this way to produce a clamping effect which opposes any forces, in particular vertical forces.

Figure 15:
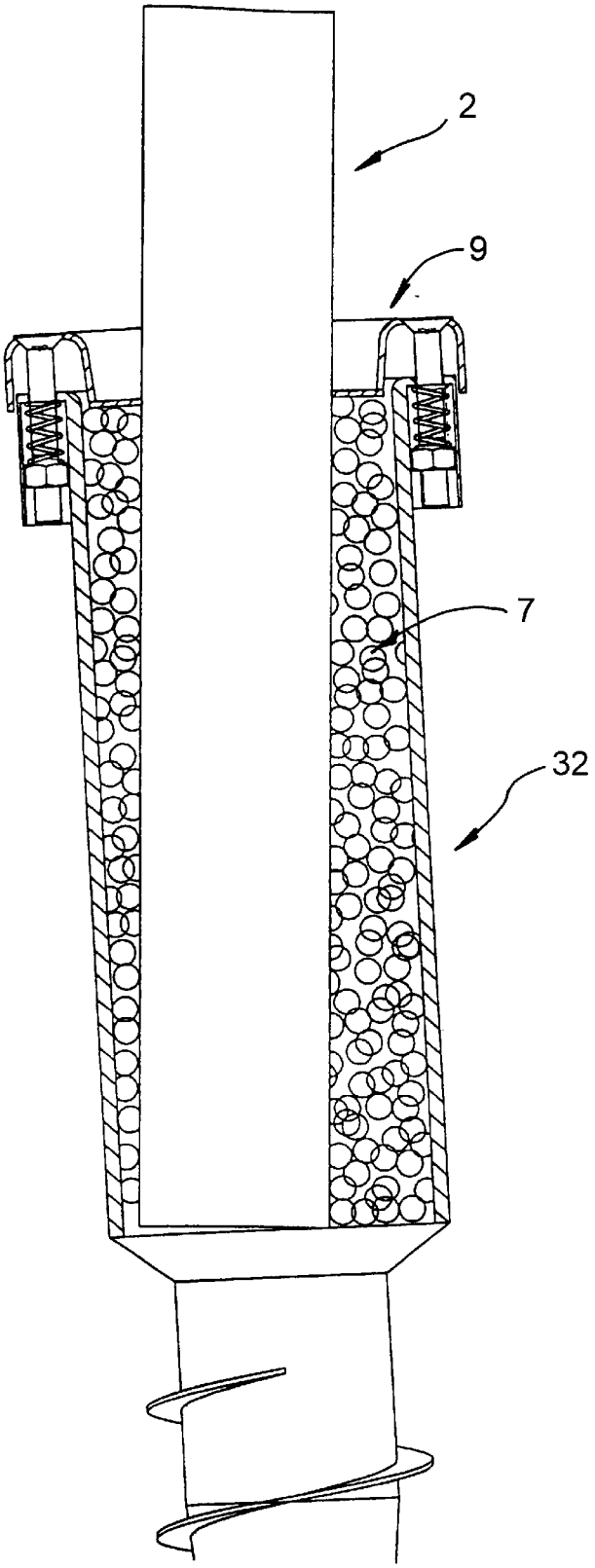
FIG. 15 shows a schematic sectional representation of a fastening system according to a further exemplary embodiment of the invention with covering means, which act as centering means, and the holding portion is filled with filler.

FIG. 15 shows a fastening system according to the invention, with a cylindrical holding portion 32, filled with filler 7, and a closing means 9, which covers the component 2 in the form of a stake or post in the upper region of the holding portion. On account of the non-compressibility of the filler, such as plastic beads or the like for example, the closing means, which is possibly kept under pressure, has the effect of producing inside the holding portion a virtually solid structure which provides a secure and reliable hold for the component in the form of a stake or post.

What is claimed is:

1. A fastening system for supporting an object of elongated shape in earth in an alignable way, the system comprising:

an anchoring portion for removable introduction into the earth having one of a threaded bottom end and a vaned bottom end;

a filler;

a holding portion for receiving the object in an alignable way;

said holding portion being wider at a top region than a bottom region for permitting tiltable alignment of the object; and said holding portion fixed to the anchoring portion, wherein the holding portion has one of a cup shaped and tubular filling portion, provided with a filling opening, for receiving the filler and the filler is granular.

2. The fastening system as claimed in claim 1, wherein the filler includes a hard material in the form one of sand, loose chippings, rock, a flexible plastic, and a combination of rock and flexible plastic.

3. The fastening system as claimed in claim 1 or 2, wherein the holding portion defines a frustoconical cavity at a lower end thereof.

4. The fastening system as claimed in claim 1 or 2, further comprising a closing means for covering the filling opening of the filling portion at least in certain regions and, the closing means being releasably fastened at an edge region of the filling portion.

5. The fastening system as claimed in claim 4, wherein the closing means includes a covering enclosing the object and closing the filling opening.

6. A fastening system for supporting an object of elongated structure in earth in an alignable way, the system comprising:

an anchoring portion for removable introduction into the earth;

a filler;

a holding portion for receiving the object in an alignable way;

said holding portion being wider at a top region than a bottom region for permitting tiltable alignment of the object; and said holding portion fixed to the anchoring portion, wherein the holding portion has one of a cup shaped and tubular filling portion, provided with a filling opening, for receiving the filler, and the filling portion for receiving the filler is formed by an insert which can be inserted into the holding portion of the anchoring device and removed again and the filler is granular.

7. A fastening system for supporting an object of elongated shape in earth in an alignable way, the system comprising:

an anchoring portion for removable introduction into the earth;

a filler, wherein the filler is granular;

a holding portion for receiving the object in an alignable way, wherein the holding portion has one of a cup shaped and tubular filling portion, provided with a filling opening, for receiving a filler;

said holding portion being wider at a top region than a bottom region for permitting tiltable aligrunent of the object;

said holding portion fixed to the anchoring portion;

a closing means for covering the filling opening of the filling portion at least in certain regions and the closing means being releasably fastened at an edge region of the filling portion; and the closing means including a covering enclosing the object and closing the filling opening, wherein the covering is formed by at least one independent, prefabricated plate of one of plastic and sheet metal, which is provided with one of clearances and passages adapted to a cross-sectional form of the object to be inserted.

8. A fastening system for supporting an object of elongated shape in earth in an alignable way, the system comprising:

an anchoring portion for removable introduction into the earth;

a filler, wherein the filler is granular;

a holding portion for receiving the object in an alignable way, wherein the holding portion has one of a cup shaped and tubular filling portion, provided with a filling opening, for receiving the filler;

said holding portion being wider at a top region than a bottom region for permitting tiltable alignment of the object;

said holding portion fixed to the anchoring portion;

a closing means for covering the filling opening of the filling portion at least in certain regions and, the closing means being releasably fastened at an edge region of the filling portion; and the closing means including a covering enclosing the object and closing the filling opening, wherein the covering includes a plurality of plates lying one on top of each other and covering the filler by overlapping.

9. A fastening system for supporting an object of elongated structure in earth in an alignable way, the system comprising:

an anchoring portion for removable introduction into the earth;

a filler;

a closing means;

a holding portion for receiving the object in an alignable way;

said holding portion being wider at a top region than a bottom region for permitting tiltable alignment of the object; and said holding portion fixed to the anchoring portion, wherein the filler is granular, the holding portion has one of a cup shaped or tubular filling portion, provided with a filling opening, for receiving the filler, and the closing means includes a clamping means, by which the filler is subjected to mechanical stress.

10. A method for fastening an object of elongated structure projecting from the earth by means of a fastening device which has an anchoring portion for removable introduction into the earth and a holding portion for receiving the object in an alignable way, comprising the steps of:

providing an anchoring portion for introduction into the earth and a holding portion having a wider top region -than bottom region thereby permitting tiltable alignment of the object, said holding portion fixed to said anchoring portion;

introducing the anchoring portion of the fastening device into the earth;

introducing, aligning and positioning the object in the holding portion of the fastening device;

filling a filler into a filling portion, provided with a filling opening, thereby securing and durably fixing the aligned position of the object.

11. The method as claimed in claim 10, further comprising the step of covering the filling opening with a closing means which covers the filling opening of the filling portion at least in certain regions and is releasably fastened at the edge region of the filling portion.

12. The method as claimed in claim 11, wherein the filler is subjected to mechanical pressure or is compressed by a clamping means.

13. The method as claimed in one of claims 10 to 12, wherein the filler includes a hard material in the form of one of sand, loose chippings, rock, a flexible plastic, and a combination of rock and a flexible plastic.

14. The method as claimed in one of claims 10 to 12, wherein the filling portion for receiving the filler is formed by an insert which can be inserted into the holding portion of the anchoring device and removed again.

15. The method as claimed in claim 14, wherein the insert is a pot and is formed by a prefabricated part of plastic or sheet metal.

16. The method as claimed in claim 15, wherein the insert is at least conically designed on the inside.

17. The method as claimed in claim 16, wherein the insert includes one of a dome-shaped eversion and depression.

18. The method as claimed in claim 17, wherein the insert includes a dome-shape eversion and the dome-shaped eversion is separabled from the insert.

19. The method as claimed in claim 11, further comprising the step of centering the object with the closing means.

20. The method as claimed in claim 10, wherein the step of introducing the anchoring portion into the earth includes applying rotational force to the anchoring portion.

21. The method as claimed in claim 10, wherein the step of introducing the anchoring portion into the earth includes applying downward force to the anchoring portion.

22. A fastening system for supporting an object of elongated shape in earth in an alignable way, the system comprising:

an anchoring portion for removable introduction into the earth;

a filler;

a holding portion for receiving the object in an alignable way;

said holding portion being wider at a top region than a bottom region for permitting tilable alignment of the object; and said holding portion fixed to the anchoring portion, wherein the holding portion has one of a cup shaped and tubular filling portion, provided with a filling opening, for receiving the filler, the filler is granular and includes a hard material in the form one of sand, loose chippings, rock, a flexible plastic and a combination of rock and a flexible plastic, and the filling portion for receiving the filler is formed by an insert which can be inserted into the holding portion of the anchoring device and removed again.

23. The fastening system as claimed in claim 6 or claim 22, wherein the insert is formed by one of a prefabricated part of plastic and sheet metal.

24. A fastening system for supporting an object of elongated shape in earth in an alignable way, the system comprising:

an anchoring portion for removable introduction into the earth;

a filler;

a holding portion for receiving the object in an alignable way, wherein the holding portion has one of a cup shaped and tubular filling portion, provided with a filling opening, for receiving the filler;

said holding portion being wider at a top region than a bottom region for permitting tiltable alignment of the object;

said holding portion fixed to the anchoring portion;

a closing means which covers the filling opening of the filling portion at least in certain regions and, the closing means being releasably fastened at an edge region of the filling portion;

the closing means including a covering enclosing the object and closing the filling opening; and the covering being formed by at least one independent, prefabricated plate of one of plastic and sheet metal, which is provided with one of clearances and passages adapted to the cross-sectional form of the object to be inserted, wherein the filler is granular and includes a hard material in the form of one of sand, loose chippings, rock a flexible plastic, and a combination of rock and a flexible plastic.

25. A fastening system for supporting an object of elongated shape in earth in an alignable way, the system comprising:

an anchoring portion for removable introduction into the earth;

a filler;

a holding portion for receiving the object in an alignable way, wherein the holding portion has one of a cup shaped and tubular filling portion, provided with a filling opening, for receiving the filler;

said holding portion being wider at a top region than a bottom region for permitting tiltable alignment of the object;

said holding portion fixed to the anchoring portion;

a closing means covering the filling opening of the filling portion at least in certain regions and being releasably fastened at an edge region of the filling portion;

the closing means including a covering enclosing the object and closing the filling opening; and the covering including a plurality of plates lying one on top of each other and covering the filler by overlapping, wherein the filler is granular and includes a hard material in the form of one of sand, loose chippings, rock, a flexible plastic and a combination of rock and a flexible plastic.

26. The fastening system as claimed in claim 8 or claim 25, wherein the plurality of plates have a sickle-shaped form, with an inner arc adapted to a crossectional form of the object to be inserted and an outer arc adapted to a radius of curvature of the filling opening.

27. The fastening system as claimed in claim 8 or claim 25, wherein passages in the plates are arranged concentrically in relation to one another.

28. A fastening system for supporting an object of elongated shape in earth in an alignable way, the system comprising:

an anchoring portion for removable introduction into the earth;

a filler;

a closing means;

a holding portion for receiving the object in an alignable way;

said holding portion being wider at a top region than a bottom region for permitting tiltable alignment of the object; and said holding portion fixed to the anchoring portion, wherein the holding portion has one of a cup shaped and tubular filling portion, provided with a filling opening, for receiving the filler, the filler is granular and includes a hard material in the form of one of sand, loose chippings, rock, a flexible plastic, and a combination of rock and flexible plastic, and the closing means includes a clamping means, by which the filler is subjected to mechanical stress.

29. The fastening system as claimed in claim 9 or claim 28, wherein the clamping means is formed by flexible elements that are attached to an edge of the holding portion and subjected to pressure.

30. The fastening system as claimed in claim 29, wherein the closing means is formed by a device which generates pressure in relation to ambient atmospheric pressure or when the closing means is subjected to pressure.

31. The fastening system as claimed in claim 30, further comprising an insert, wherein the insert is formed by one of a prefabricated part of plastic and sheet metal.

32. A fastening system for supporting an object of elongated shape in earth in an alignable way, the system comprising:

an anchoring portion supporting the object having one of a threaded bottom end and a vaned bottom end;

a holding portion partially surrounding the object and supporting the object in an alignable way; and a filler placed in the holding portion, wherein the holding portion is frusto-conical shaped.

33. The fastening system according to claim 32, wherein the filler includes one of sand, loose chippings, rock, a flexible plastic, and a combination of rock and flexible plastic.

34. The fastening system according to claim 32, wherein the holding portion includes an insert.

35. The fastening system according to claim 34, wherein the insert is a pot and is formed by one of a prefabricated plastic and sheet metal.

36. The fastening system according to claim 35, wherein the insert is at least conically designed on an inside surface.

37. The fastening system according to claim 34, wherein the insert includes one of a dome shaped eversion and depression.

38. The fastening system according to claim 37, wherein the insert includes a dome-shaped eversion and the dome-shaped eversion is separable from the insert.

39. The fastening system according to claim 32, wherein the holding portion defines a frustoconical cavity at a lower end thereof.

40. The fastening system according to claim 32, further comprising a closing means for covering a filling opening of the holding portion at least in certain regions and, the closing means being releasably fastened at an edge region of a filling portion.

41. The fastening system according to claim 40, further comprising the closing means including a covering for enclosing the object and closing the filling portion.

42. The fastening system according to claim 41, wherein the covering is formed by at least one independent, prefabricated plate of one of plastic and sheet metal, which is provided with one of clearances and passages adapted to the cross-sectional form of the object to be inserted.

43. The fastening system according to claim 41, wherein the covering includes a plurality of plates lying one on top of each other and covering the filler by overlapping.

44. The fastening system according to claim 43, wherein the plurality of plates have a sickle-shaped form, with an inner arc adapted to a crossectional form of the object to be inserted and an outer arc adapted to a radius of curvature of the filling opening.

45. The fastening system according to claim 43, further comprising passages arranged concentrically in the plurality of plates.

46. The fastening system according to claim 40, further comprising the closing means including a clamping means for subjecting the filler to mechanical stress.

47. The fastening system according to claim 46, wherein the clamping means is formed by flexible elements that are attached to an edge of the holding portion and subjected to pressure.

48. The fastening system according to claim 40, wherein the closing means is formed by a device which generates pressure in relation to one of ambient atmospheric pressure and when the closing means is subjected to pressure.

49. The fastening system according to claim 40, further comprising the closing means including a centering means for centering the object.

* * * * *